United States Patent [19]

Turner

[11] 4,294,654

[45] Oct. 13, 1981

[54] DELIGNIFICATION AND BLEACHING OF LIGNOCELLULOSIC PULP VIA PHOTO-OXYGENATION

[75] Inventor: Rex H. Turner, Mobile, Ala.

[73] Assignee: International Paper Company, New York, N.Y.

[21] Appl. No.: 132,604

[22] Filed: Mar. 21, 1980

[51] Int. Cl.[3] ..... D21C 5/00; D21C 9/10

[52] U.S. Cl. ..... 162/50; 162/65

[58] Field of Search ..... 162/50, 65

[56] References Cited

U.S. PATENT DOCUMENTS

| | | | |
|---|---|---|---|
| 1,582,677 | 4/1926 | Goodall | 250/433 |
| 1,850,808 | 3/1932 | Redd | 162/50 |
| 2,161,045 | 6/1939 | Hirschkind et al. | 162/50 |
| 3,806,404 | 4/1974 | Liebergott et al. | 162/65 |
| 3,832,276 | 8/1974 | Roymoulik et al. | 162/65 |
| 4,008,120 | 2/1977 | Carles et al. | 162/89 |

FOREIGN PATENT DOCUMENTS

| | | |
|---|---|---|
| 2711900 | 6/1978 | Fed. Rep. of Germany . |
| 2255418 | 7/1975 | France . |

OTHER PUBLICATIONS

Berge et al., ATIP Rev., 30, No. 5, (1976), 161–166.

Gellerstedt et al., Svensk Papperstid., 80, No. 1 (1977), 15–21.

Gellerstedt et al., ACTA Chem. Scand., 29B, No. 10, (1975) 1005–1010.

Carlsson et al., J. Polymer Sci., (B. Polymer Letters), 14, No. 8 (1976), 493–498.

Gellerstedt et al., "Singlet Oxygen Oxidation of Lignin Structures", Canadian Wood Chem. Symp. (Mont Gabriel, Quebec).

Meshitsuka et al., TAPPI, 59, No. 11 (1976), 123–125.

Markham, TAPPI, 60, No. 9 (1977), 138–140.

Nimz et al., "Oxidation of Lignin Model Compounds with Hydrogen Peroxide, Peracetic Acid and Singlet Oxygen", 11th European ESPRA Meeting, May 1979.

*Primary Examiner*—Peter Chin

*Attorney, Agent, or Firm*—Jay S. Cinamon

[57] ABSTRACT

A process for the delignification and bleaching of lignocellulosic pulp employing electronically excited oxygen generated in situ which comprises subjecting an aqueous slurry of said lignocellulosic pulp having a consistency of from about 0.01% to about 10.0%, by weight of oven-dried pulp, and whose slurry pH is between about 8 and about 13 to irradiation with ultraviolet light while admitting oxygen into said slurry.

12 Claims, No Drawings

DELIGNIFICATION AND BLEACHING OF LIGNOCELLULOSIC PULP VIA PHOTO-OXYGENATION

BACKGROUND OF THE INVENTION

The present invention relates generally to a process for the delignification and bleaching of lignocellulosic pulps. More particularly, the invention relates to a photo-oxygenation process for the delignification and bleaching of lignocellulosic pulps employing electronically excited species of oxygen generated in situ.

The development and adaptation of new oxidizing agents and processes in the pulp and paper industry is of interest due to manufacturing, pulp quality and environmental considerations. In recent years the pulp and paper industry has devoted considerable effort to the development and implementation of chlorine-free processes, or in the alternative processes employing reduced amounts of chlorine. These efforts have been mounted, in large part, to comply with increasingly stringent governmental regulations dictating the reduction or elimination of pollutants in both the atmosphere and the water.

One direction taken by investigators has been to conduct extensive research into various oxygen bleaching systems. While this research has proven fruitful, as attested to by the installation of several commercial pulp bleaching facilities employing oxygen as a stage in their bleaching sequence, oxygen bleaching cannot produce pulps of sufficient brightness standing alone. Another avenue which has been explored is the use of ozone as a bleaching agent, either by itself or following an oxygen bleaching stage. While ozone is an effective bleaching agent, in that it produces pulps of high brightness and which are free of chlorine, it suffers from the infirmity of causing extensive depolymerization of cellulose at the temperatures normally employed in bleach plant operations.

Another approach taken by bleaching researchers, has been investigations into the use of singlet oxygen. The work on singlet oxygen chemistry in the pulp and paper industry can be classified as falling into one of the following categories:

1. A process for the delignification and bleaching of hardwood kraft pulp using chlorine-containing compounds in combination with oxygen-containing compounds, which, through reaction in situ give rise to gaseous chlorine compounds and oxygen in a singlet or high energy state. (Berge et al., ATIP Rev., 30, No. 5, 161–166 (1976); French Pat. No. 2,255,418.)

2. Liebergott's process disclosed in U.S. Pat. No. 3,806,404 for the delignification and bleaching of chemical and mechanical pulp using active or high-energy gases generated by passing the gas through a Corona discharge and subsequently mixing the gas with pulp at high consistency.

3. Studies made with pure model lignin compounds using singlet oxygen generated via photo-oxygenation to gain a better understanding of factors influencing color reversion of cellulosics. Some of these studies suggest that singlet oxygen attack on the polysaccharide is not an important factor in cellulose photo-degradation. (Gellerstedt et al., Svensk Papperstid., 80, No. 1, 15–21 (1977); Gellerstedt et al., ACTA Chem. Scand., 29B, No. 10, 1005–1010 (1975); Carlsson et al., J. Polymer Sci., (B. Polymer Letters), 14, No. 8, 493–498 (1976); Gellerstedt et al., "Singlet Oxygen Oxidation of Lignin Structures", Canadian Wood Chemical Symp. (Mont Gabriel, Quebec). Extended Abstr. (SPPA, Montreal): 21–24 (Sept. 1–3, 1976); Meshitsuka et al., TAPPI 59, No. 11 (1976); Knubben, Auslegeschrift, German Pat. No. P 27 11 900.2-45).

4. Processes for the delignification and bleaching of lignocellulosic pulps using chlorine compounds in the presence of ultraviolet light. (Markham, TAPPI, 60, No. 9 (1977); U.S. Pat. No. 2,161,045).

5. Processes for bleaching and sterilization of a pulp web using ultraviolet light and a subsequent application of ozone. (U.S. Pat. Nos. 1,582,677 and 1,850,808).

The Liebergott et al., patent referred to above, U.S. Pat. No. 3,806,404, discloses the activation of various gases, including oxygen, by passage of such gases through a Corona discharge and subsequently treating fluffed softwood pulp at a consistency of 15% to 95% with the activated gas, resulting in the delignification and bleaching of chemical and mechanical pulps. The use of electronically excited states of oxygen with softwood is disclosed by Liebergott in Example 1(1), but the data in Table I in Liebergott indicate that activated oxygen was only marginally effective in delignifying and bleaching lignocellulosic pulps. Reference to Table I of the Liebergott patent indicates that subsequent to bleaching the Kappa number of the pulp was 22.6, which represents a reduction of only 1.4 units, which translates into a percentage reduction of only 5.8%. Certainly, careful study of the entire Liebergott patent would leave one skilled in the art with the realization that activated nitrogen was found by Liebergott to be extremely effective, while activated oxygen, under the same reaction conditions, was found to be ineffective.

SUMMARY OF THE INVENTION

It has now quite unexpectedly been found, and contrary to the marginal results obtained by Liebergott et al. in U.S. Pat. No. 3,806,404 when employing electronically excited states of oxygen, generated via Corona discharge, with softwood pulps having consistencies from 15% to 95%, that an effective process for the delignification and bleaching of low consistency lignocellulosic pulps, especially hardwood pulps, is achieved by a process which generates electronically excited oxygen in situ which comprises subjecting an aqueous lignocellulosic pulp slurry, having a consistency of from about 0.01% to about 10%, based upon the weight of oven-dried pulp, and whose slurry pH is between about 8 and 13, to irradiation with ultraviolet light while admitting oxygen gas into said pulp slurry. Employing the process of the present invention results in significant reduction in the permanganate number of the pulp, for example, on the order of 90%, while significantly increasing the brightness of the pulp, on the order of at least about 50%. Hardwood and softwood kraft pulps prepared in accordance with the present invention can be used as dissolving pulp in the manufacture of rayon and cellophane and in the manufacture of paper.

DETAILED DESCRIPTION OF THE INVENTION

The lignocellulosic pulp fibers employed in the process of the present invention can either be unbleached, or preferably they can be partially bleached; for example, by prior bleaching with oxygen in the presence of alkali. Such a prior oxygen bleaching can be done at either high pulp consistency or at low pulp consistency.

Exemplary of a suitable low consistency oxygen/alkali bleaching process is disclosed in Roymoulik et al., U.S. Pat. No. 3,832,276.

The lignocellulosic pulps employed in the present process can be prepared from hardwood, such as oak and gum, or softwoods, such as Southern pine, by various chemical, semichemical or mechanical pulping processes, exemplary of which are the kraft process, the sulfite process, the soda process, the neutral sulfite semichemical process, the groundwood process, or the thermomechanical pulping process. Prehydrolyzed hardwood pulp prepared by the kraft process has been found to be preferred for use in the present process.

While the consistency of the pulp in accordance with the present process can be from about 0.01% to about 10%, based upon the weight of oven-dried pulp, preferably the pulp consistency should be between about 0.1% to about 2%, and most preferably between about 0.2% and about 1.0%, to achieve satisfactory delignification while increasing the brightness.

The photo-oxygenation reaction via irradiation with ultraviolet light can take place in any suitable reaction vessel which has been provided with: (1) a source of ultraviolet light; (2) agitation means; (3) a cooling coil or jacketed reaction vessel for maintaining the temperature at a constant rate throughout the period of reaction; and (4) a means for bubbling in the oxygen in the form of a finely divided gaseous stream to effectively disperse the gas for efficient in situ generation of electronically excited oxygen. As employed in this application "in situ" is defined to mean the generation of electronically excited oxygen in the pulp slurry.

The starting pH of the pulp slurry is adjusted to an alkaline pH, preferably between about 8.0 to about 13, and most preferably between about 10.0 and about 12.5. Depending upon the pH of the pulp prior to its reaction in accordance with the present invention, the pH of the slurry is adjusted by the use of either sodium hydroxide or sulfuric acid or other suitable bases or acids depending upon the pH of the pulp after completion of any preceeding bleaching stages.

Since viscosity control plays an important role in most pulping processes, lower temperatures for the slurry water have been found to be preferable since they have been shown to produce reduced amounts of pulp viscosity loss. Accordingly, while the temperature of the pulp slurry can be from about 0° C. to about 100° C., it is preferable that the temperature during the irradiation be within the range of about 10° C. to about 50° C., and most preferably between about 20° C. and 30° C.

The stream of oxygen is admitted into the reaction vessel, containing the alkaline pulp slurry, in the form of a finely divided stream of pure oxygen. In order to provide a smooth and uninterrupted flow of oxygen, there is provided a sparging means which will admit the oxygen into the pulp slurry in the form of bubbles. Various sparging means can be employed, exemplary of which are a porous disc, a sparging ring, a pumice stone, all of which have a plurality of openings for providing the requisite flow. The amount of oxygen provided to the pulp slurry is directly dependent upon and a function of the volume of the reaction vessel.

The amount and type of agitation required for the present process is such that it be sufficient to maintain the pulp slurry in a homogeneous state. This can be accomplished by using a Lightnin mixer or any other suitable mechanical agitation means which will insure homogenity of the slurry during the reaction.

While any ultraviolet light source whose spectral characteristics ranging from the far ultraviolet through the middle and near ultraviolet and also through the visible and infra-red range can be employed, it is especially preferred to employ an ultraviolet light source where the greatest percentage of radiated energy lies in the range of about 3,500 angstroms to about 3,000 angstroms since singlet oxygen is known to be produced in that range. While it is also known that singlet oxygen is produced in the range of 2200A to 3,000A, it has been shown that ultraviolet light of that wavelength range tends to degrade cellulose to a greater extent than ultraviolet light in the range of 3000A to 3500A.

One means of attaining the more desirable light wavelengths and filtering out the less desirable ones is to employ either quartz or glass filters. Such filters alter the light source wavelength spectrum and also the total energy input to the pulp slurry in a given irradiation time period, but the effects of such filters on certain reaction parameters on various pulp properties, such as brightness and delignification, are similar.

While most if not all processes employing ultraviolet light typically require the presence of photo-sensitizers, it has been found in the present process that photo-sensitizers do not confer any added benefit, at least at concentration levels of 0.5%, based on O.D. pulp.

While the most unexpected and most dramatic results insofar as increased delignification and brightness have been experienced with kraft hardwood pulps, beneficial effects have also been noted with softwood pulps. The examples also clearly demonstrate that the photochemical in situ generation of excited electronic states of oxygen, specifically singlet oxygen, via irradiation with ultraviolet light significantly delignifies and bleaches lignocellulosic pulps, which would not have been predicted from the work of earlier investigators who employed Corona discharge.

The examples which follow are primarily for the purpose of illustrating the nature of the present invention more clearly. It should be understood, however, that this is done solely by way of example and is intended neither to delineate the scope of the invention nor to limit the ambit of the appended claims.

GENERAL PROCEDURE EMPLOYED IN THE EXAMPLES

In each of the fourteen (14) examples which follow, the general procedure employed, as well as the apparatus employed, is as indicated below. If the procedure or apparatus employed varied in any respect, it will be indicated in each specific example where any such change occurred.

The ultraviolet light source was a Hanovia lamp 679A36, 917456, High Pressure, Quartz, Mercury Vapor, 450 Watts, 3.7 Amps, Length 109.54 mm., Total Length 346.54 mm. having the following spectral characteristics (Watts)

| | |
|---|---|
| Far UV (2200A - 2800A) | 27.0 |
| Middle UV (2800A - 3200A) | 28.7 |
| Near UV (3200A - 4000A) | 28.0 |
| Visible (4000A - 6000A) | 75.7 |
| Infra-red (10000A - 14000A) | 16.4 |
| Total Radiated Energy | 175.8 |

The reaction vessel employed was a Griffin beaker having a capacity of 4,000 milliliters. The temperature was maintained constant by use of a cooling coil consisting of quarter inch (¼) O.D. stainless steel tubing through which water was passed. Agitation of the pulp slurry was provided by a Lightnin mixer (Model L) and the oxygen or any other gas employed, was admitted into the pulp slurry at a rate of 5 standard liters per minute through a pumice stone having a diameter of one (1) inch.

Initially, 10 gms., oven-dried (O.D.) basis, of an unbleached, neutral, prehydrolyzed kraft hardwood pulp was placed in the reaction vessel. The kraft pulp used in Examples 1–9 had, during its preparation, been treated with cold caustic, followed by washing with water until the pH was approximately neutral, after which the pulp was screened. It was then diluted with water to give a pulp slurry having a consistency as noted in each of the examples or the accompanying tables.

A photo-sensitizer was employed only in Example 1. In each of the fourteen (14) examples which follow, oxygen was employed and it was always admitted or introduced at the rate of 5 standard liters per minute. In those examples, where nitrogen or air were employed, namely 4, 5 and 14, they too were admitted at the rate of 5 standard liters per minute. The pulp slurry was continuously agitated using the Lightnin mixer to maintain the slurry in a homogeneous state. The pulp was irradiated with the Hanovia lamp which was submerged in the slurry for the periods of time noted in each example or table and a glass filter was used in each example in the form of a sleeve or tube which encased the Hanovia lamp. The particular filter employed is set forth in each example or table. After completing the reaction, the pulp was collected in a Buchner funnel and washed with room temperature distilled water until the filtrate was colorless. The pulp was then tested for permanganate number, Diano brightness and viscosity.

EXAMPLE 1

In this example the pulp consistency was 0.28% and the photosensitizer employed in Run Nos. 1–4 was 0.5% eosin, by weight of O.D. pulp. Neither the pH nor the temperature were controlled and they ranged, respectively, between 6.3 to 8.5 and between 20° C. to 90° C. A Vycor filter was employed.

TABLE I

PHOTO-OXYGENATION OF LABORATORY-MADE PREHYDROLYZED KRAFT HARDWOOD PULP (COLD CAUSTIC TREATED, WASHED AND SCREENED) SLURRY

| Run No. | Sensitizer | Irradiation Time, Min. | Permanganate No. | Diano Brightness % | Viscosity xan. sec. | Viscosity cp. |
|---|---|---|---|---|---|---|
| Control | — | — | 3.5 | 47 | 570 | 27.3 |
| 1. | Yes | 15 | 3.5 | 48 | 359 | 23.6 |
| 2. | Yes | 30 | 3.0 | 49 | 264 | 21.2 |
| 3. | Yes | 45 | 2.3 | 49 | 160 | 18.2 |
| 4. | Yes | 60 | 1.4 | 55 | 70 | 14.0 |
| 5. | No | 15 | 3.2 | 48 | 233 | 20.6 |
| 6. | No | 30 | 2.9 | 51 | 119 | 16.4 |
| 7. | No | 45 | 2.5 | 53 | 88 | 15.0 |
| 8. | No | 60 | 1.4 | 59 | 41 | 11.8 |

It is apparent from Table I that use of a photo-sensitizer is not required for generation of electronically excited oxygen species in view of the significant delignification achieved in the absence thereof. It is thought that certain wood components in the slurry may be acting as photo-sensitizers.

EXAMPLE 2

In this example the slurry was maintained at pH 12.0, the pulp consistency was 0.28%, the slurry temperature was 20° C. and a Vycor filter was employed.

TABLE II

EFFECT OF IRRADIATION TIME ON PULP PROPERTIES OF PHOTO-OXYGENATED LABORATORY-MADE PREHYDROLYZED KRAFT HARDWOOD PULP (COLD CAUSTIC TREATED, WASHED AND SCREENED) SLURRY

| Run No. | Irradiation Time, Min. | Permanganate No. | Diano Brightness % | Viscosity xan. sec. | Viscosity cp. |
|---|---|---|---|---|---|
| Control | 0 | 3.5 | 47 | 570 | 27.3 |
| 1. | 15 | 2.1 | 52 | 193 | 19.3 |
| 2. | 30 | 1.7 | 62 | 50 | 12.6 |
| 3. | 45 | 1.5 | 67 | 32 | 10.9 |
| 4. | 60 | 0.4 | 74 | 17 | 9.0 |
| 5. | 60 | 0.3 | 77 | 13 | 8.2 |
| 6. | 60 | 0.3 | 76 | 12 | 8.0 |

Table II demonstrates that reduction in permanganate number, which evidences lignin removal, increase in brightness, as well as the two viscosity measurements, are dependent upon irradiation time. In general all pulp properties are apparently directly related to the total energy input of the system for a given amount of pulp.

EXAMPLE 3

In this example, the pulp consistency was 0.28%, the temperature of the slurry was maintained at 20° C., the slurry was irradiated for 60 minutes, and a Vycor filter was used.

TABLE III

EFFECT OF PULP SLURRY pH ON THE PROPERTIES OF PHOTO-OXYGENATED LABORATORY-MADE PREHYDROLYZED KRAFT HARDWOOD PULP (COLD CAUSTIC TREATED, WASHED AND SCREENED) SLURRY

| Run No. | pH of Pulp Slurry | Permanganate No. | Diano Brightness % | Viscosity xan. sec. | Viscosity cp. |
|---|---|---|---|---|---|
| Control | — | 3.5 | 47 | 570 | 27.3 |
| 1. | 3.5 | 1.1 | 56 | 45 | 12.6 |
| 2. | 4.9 | 1.6 | 56 | 42 | 11.9 |
| 3. | 5.5 | 1.4 | 60 | 34 | 11.2 |
| 4. | 8.0 | 1.4 | 58 | 44 | 12.1 |
| 5. | 10.0 | 0.9 | 62 | 39 | 11.6 |
| 6. | 12.1 | 0.3 | 76 | 12 | 8.0 |
| 7. | 12.1 | 0.3 | 77 | 13 | 8.2 |
| 8. | 12.1 | 0.4 | 74 | 17 | 9.0 |

Table III demonstrates the dramatic effect of pulp slurry pH on resultant pulp properties. Pulp properties improve exponentially as the slurry pH approaches 12.

EXAMPLE 4

The pulp consistency was 0.28%, the slurry pH was 12.0, the temperature of the slurry was 20° C. and a Vycor filter was employed. In Run Nos. 1 and 2, the slurry was first purged with nitrogen before nitrogen gas was admitted at 5 standard liters per minute during the experimental run.

TABLE IV

EFFECT OF DISPERSED OXYGEN AND NITROGEN ON PULP PROPERTIES OF PHOTO-OXYGENATED LABORATORY-MADE PREHYDROLYZED KRAFT HARDWOOD PULP (COLD CAUSTIC TREATED, WASHED AND SCREENED) SLURRY

| Run No. | Type of Gas Dispersed in Slurry | Irradiation Time, Minutes | Permanganate Number | Diano Brightness % | Viscosity xan, sec. | Viscosity cp. |
|---|---|---|---|---|---|---|
| Control | — | — | 3.5 | 47 | 570 | 27.3 |
| 1. | Nitrogen | 30 | 1.9 | 50 | 139 | 17.3 |
| 2. | Nitrogen | 60 | 1.5 | 51 | 46 | 12.3 |
| 3. | Oxygen | 30 | 1.7 | 62 | 50 | 12.6 |
| 4. | Oxygen | 60 | 0.4 | 74 | 17 | 9.0 |

The data in Table IV and Table V demonstrate the importance of oxygen as dispersed gas in this process. Contrary to previous work by Liebergott, U.S. Pat. No. 3,806,404, using activated nitrogen as the bleaching agent, the data in these examples demonstrate that nitrogen is not as effective as pure oxygen. Air and dissolved oxygen in water gave pulp properties inferior to those of oxygen but superior to those of nitrogen.

EXAMPLE 5

In this example, as in Example 4, the pulp consistency was 0.28%, the slurry pH was 12.0, the temperature of the slurry was 20° C. and a Vycor filter was employed. In Run Nos. 9–12, no gas was introduced into the pulp slurry, other than that previously dissolved in the water.

TABLE V

EFFECT OF DISPERSED OXYGEN AND AIR ON PULP PROPERTIES OF PHOTO-OXYGENATED LABORATORY-MADE PREHYDROLYZED KRAFT HARDWOOD PULP (COLD CAUSTIC TREATED, WASHED AND SCREENED) SLURRY

| Run No. | Type of Gas Dispersed in Slurry | Irradiation Time, Minutes | Permanganate Number | Diano Brightness % | Viscosity xan, sec. | Viscosity cp. |
|---|---|---|---|---|---|---|
| Control | — | — | 4.8 | 42 | 446 | 25.2 |
| 1. | Air | 15 | 3.3 | 46 | 203 | 19.5 |
| 2. | Air | 30 | 2.4 | 53 | 68 | 13.8 |
| 3. | Air | 45 | 1.8 | 58 | 44 | 12.1 |
| 4. | Air | 60 | 1.6 | 63 | 30 | 10.7 |
| 5. | Oxygen | 15 | 3.8 | 44 | 268 | 21.4 |
| 6. | Oxygen | 30 | 2.0 | 56 | 84 | 14.8 |
| 7. | Oxygen | 45 | 1.3 | 64 | 51 | 12.6 |
| 8. | Oxygen | 60 | 0.8 | 71 | 32 | 10.9 |
| 9. | None | 15 | 3.2 | 47 | 152 | 17.9 |
| 10. | None | 30 | 2.2 | 52 | 82 | 14.7 |
| 11. | None | 45 | 1.6 | 60 | 39 | 11.8 |
| 12. | None | 60 | 1.2 | 65 | 24 | 10.0 |

EXAMPLE 6

In this example the slurry pH was maintained at 12.0, and the slurry temperature was maintained at 20° C. and a Vycor filter was employed.

TABLE VI

EFFECT OF SLURRY CONSISTENCY ON PULP PROPERTIES OF PHOTO-OXYGENATED LABORATORY-MADE PREHYDROLYZED KRAFT HARDWOOD PULP (COLD CAUSTIC TREATED, WASHED AND SCREENED) SLURRY

| Run No. | Consistency % | Irradiation Time, Min. | Permanganate No. | Diano Brightness % | Viscosity xan. sec. | Viscosity cp. |
|---|---|---|---|---|---|---|
| Control | — | — | 3.5 | 47 | 570 | 27.3 |
| 1. | 0.28 | 60 | 0.4 | 74 | 17 | 9.0 |
| 2. | 0.56 | 60 | 0.9 | 62 | 58 | 12.8 |
| 3. | 0.84 | 60 | 1.4 | 58 | 67 | 13.4 |
| Control | — | — | 4.8 | 41 | 446 | 25.2 |
| 4. | 0.28 | 60 | 0.8 | 71 | 32 | 10.9 |
| 5. | 0.28 | 120 | 0.5 | 81 | 8 | — |
| 6. | 0.34 | 60 | 0.9 | 65 | 27 | 10.4 |
| 7. | 0.56 | 15 | 2.9 | 46 | 323 | 22.7 |
| 8. | 0.56 | 30 | 2.3 | 50 | 153 | 17.9 |
| 9. | 0.56 | 45 | 1.7 | 56 | 83 | 14.7 |
| 10. | 0.56 | 60 | 1.5 | 57 | 75 | 14.3 |
| 11. | 1.12 | 60 | 3.2 | 46 | 221 | 20.1 |
| 12. | 1.12 | 90 | 2.8 | 50 | 183 | 19.0 |
| 13. | 1.12 | 120 | 2.5 | 53 | 176 | 18.7 |
| 14. | 1.12 | 180 | 1.4 | 66 | 86 | 14.9 |

The data in Table VI demonstrate that as the pulp slurry consistency increases, the irradiation time necessary to achieve a given permanganate number, brightness, or pulp viscosity increases.

EXAMPLE 7

In this example, the consistency of the pulp slurry was 0.28%, the pH was 12, and the slurry was irradiated for 60 minutes employing a Vycor filter.

TABLE VII

EFFECT OF SLURRY TEMPERATURE ON PULP PROPERTIES OF PHOTO-OXYGENATED (WITH AIR) LABORATORY-MADE PREHYDROLYZED KRAFT HARDWOOD PULP (COLD CAUSTIC TREATED, WASHED AND SCREENED) SLURRY

| Run No. | Slurry Temperature, °C. | Permanganate Number | Diano Brightness % | Viscosity xan. sec. | Viscosity cp. |
|---|---|---|---|---|---|
| Control | — | 4.8 | 42 | 446 | 25.2 |
| 1. | 18 | 1.6 | 63 | 30 | 10.7 |
| 2. | 52 | 1.3 | 66 | 21 | 9.5 |
| 3. | 90 | 1.3 | 64 | 16 | 8.8 |

The date in Table VII indicate that slurry water temperature during photo-oxygenation is not an important parameter with regard to pulp properties, except insofar as pulp viscosity is concerned. Lower temperatures are preferred because control of viscosity is important in most delignification processes.

EXAMPLE 8

In this example, the pulp consistency was 0.28%, the temperature of the slurry was maintained at 20° C., the slurry pH was 12.0, and a Vycor filter was employed.

After completion of the photo-oxygenation, the pulp, at 10% consistency, was extracted with 1.5% sodium hydroxide for 90 minutes at 160° F.

TABLE VIII

EFFECT OF A CAUSTIC EXTRACTION STAGE ON PULP PROPERTIES OF PHOTO-OXYGENATED LABORATORY-MADE PREHYDROLYZED KRAFT HARDWOOD PULP (COLD CAUSTIC TREATED, WASHED AND SCREENED) SLURRY

| Run No. | Caustic Extraction | Irradiation Time, Minutes | Permanganate Number | Diano Brightness % | Viscosity xan. sec. | Viscosity cp. |
|---|---|---|---|---|---|---|
| 1. | None | 15 | 3.8 | 44 | 268 | 21.4 |
| 2. | Yes | 15 | 3.5 | 47 | 225 | 20.2 |
| 3. | None | 30 | 2.0 | 56 | 84 | 14.8 |
| 4. | Yes | 30 | 2.2 | 56 | 97 | 15.5 |
| 5. | None | 45 | 1.3 | 64 | 51 | 12.6 |
| 6. | Yes | 45 | 1.7 | 62 | 60 | 13.3 |
| 7. | None | 60 | 0.8 | 71 | 32 | 10.9 |
| 8. | Yes | 60 | 1.3 | 66 | 50 | 12.6 |

The date in Table VIII show that a caustic extraction stage after photo-oxygenation does not improve the resultant pulp properties.

EXAMPLE 9

In this example, the consistency of the pulp was 0.28%, the slurry pH was 12.0, the temperature of the slurry was maintained at 20° C., and the irradiation time was 60 minutes.

TABLE IX

EFFECT OF IRRADIATION FILTER EMPLOYED ON THE PULP PROPERTIES OF PHOTO-OXYGENATED LABORATORY-MADE PREHYDROLYZED KRAFT HARDWOOD PULP (COLD CAUSTIC TREATED, WASHED AND SCREENED) SLURRY

| Run No. | Type of Filter | pH of Slurry | Permanganate No. | Diano Brightness % | Viscosity xan. sec. | Viscosity cp. |
|---|---|---|---|---|---|---|
| Control | — | — | 3.5 | 47 | 570 | 27.3 |
| 1. | Corex | 4.0 | 2.3 | 51 | 285 | 21.9 |
| 2. | Corex | 8.0 | 2.3 | 51 | 428 | 24.9 |
| 3. | Corex | 12.1 | 1.5 | 56 | 218 | 20.0 |
| 4. | Pyrex | 8.0 | 2.5 | 53 | 372 | 23.9 |
| 5. | Pyrex | 8.0 | 2.2 | 53 | 392 | 24.3 |
| 6. | Vycor | 4.9 | 1.6 | 56 | 42 | 11.9 |
| 7. | Vycor | 8.0 | 1.4 | 58 | 44 | 12.1 |
| 8. | Vycor | 12.1 | 0.3 | 77 | 13 | 8.2 |

Data in Table IX, and in Table X which follows, show that while glass light filters alter the source wavelength spectrum and the total energy input to the pulp slurry in a given irradiation period, the effects of reaction parameters on pulp properties, namely, delignification, brightness increase, etc., are similar. Pulp viscosity loss using Corex and Pyrex filters does not seem to be as great at equivalent pulp brightness and delignification compared with the pulp viscosity losses using the Vycor filter.

EXAMPLE 10

The pulp employed in this example was not treated with cold caustic after completion of the kraft process. The pulp was washed to neutrality with water and screened.

One-third of the washed and screened pulp was made into a slurry having a consistency of 0.28%, a slurry pH of 12.0, a slurry temperature of 20° C., and was irradiated for the time periods indicated in Run Nos. 1–4 in Table X employing a Vycor filter.

The remaining two-thirds of the pulp was treated with cold caustic. Thereafter, one-half of the cold caustic treated pulp was used in Run Nos. 5–8. The pH, temperature, consistency and the filter were the same as in Run Nos. 1–4.

The remaining one-half of the cold caustic treated pulp was bleached with oxygen employing the following procedure. Six grams of oven-dried pulp was charged into a 20-gallon Pfaudler reactor. The pulp was diluted with sufficient aqueous sodium hydroxide solution to give a pulp consistency of 3.5%, based on O.D. pulp, and a concentration of sodium hydroxide of 2 grams per liter. The pulp slurry was heated to 220° F. and oxygen was then added to the system to flush air therefrom. The system was then pressurized to 100 p.s.i.g. and the slurry was mixed at 250 R.P.M. for 20 minutes. The pulp was then water washed to neutrality. Then in Run Nos. 9–12 the pulp was employed in the process of the present invention. The pH temperature, consistency and the filter employed were the same as in Run Nos. 1–8.

TABLE X

PHOTO-OXYGENATION OF LABORATORY-MADE PREHYDROLYZED KRAFT HARDWOOD PULP (WASHED AND SCREENED) SLURRY AFTER VARIOUS SIMULATED PROCESSING STAGES

| Run No. | Irradiation Time, Minutes | Permanganate Number | Diano Brightness % | Viscosity xan. sec. | Viscosity cp. |
|---|---|---|---|---|---|
| Control | — | 7.1 | 37 | 1952 | 40.3 |
| 1. | 15 | 3.8 | 44 | 268 | 21.4 |
| 2. | 30 | 2.0 | 56 | 84 | 14.8 |
| 3. | 45 | 1.3 | 64 | 51 | 12.6 |
| 4. | 60 | 0.8 | 71 | 32 | 10.9 |
| Control | — | 4.8 | 42 | 446 | 25.2 |
| 5. | 15 | 2.7 | 48 | 114 | 16.3 |
| 6. | 30 | 1.1 | 60 | 38 | 11.5 |
| 7. | 45 | 0.7 | 66 | 21 | 9.5 |
| 8. | 60 | 0.5 | 70 | 14 | 8.4 |
| Control | — | 1.6 | 54 | 83 | 14.7 |
| 9. | 15 | 0.8 | 65 | 38 | 11.5 |
| 10. | 30 | 0.4 | 73 | 22 | 9.7 |
| 11. | 45 | 0.3 | 76 | 17 | 9.0 |
| 12. | 60 | 0.1 | 79 | 12 | 8.0 |

EXAMPLE 11

In this example a kraft pine pulp, which had been washed and screened, was employed. The pulp slurry had a consistency of 0.28%, a pH of 12.0, the slurry temperature was maintained at 20° C., and a Vycor filter was employed.

TABLE XI

EFFECT OF IRRADIATION TIME ON PULP PROPERTIES OF PHOTO-OXYGENATED LABORATORY-MADE KRAFT PINE PULP (WASHED AND SCREENED)

| Run No. | Irradiation Time, Min. | Permanganate No. | Diano Brightness % | Viscosity xan. sec. | Viscosity cp. |
|---|---|---|---|---|---|
| Control | — | 24.8 | 19 | 341 | 23.2 |
| 1. | 30 | 20.4 | 18 | 195 | 19.3 |
| 2. | 60 | 15.3 | 24 | 158 | 18.0 |
| 3. | 90 | 15.1 | 24 | 135 | 17.2 |
| 4. | 120 | 13.3 | 26 | 112 | 11.3 |

Table XI, and XII which follows, indicate the effect of photo-oxygenation parameters on resultant pulp properties of pine pulps. In general, hardwood pulps require less energy than pine pulps to achieve equivalent pulp properties.

EXAMPLE 12

In this example, as in Example 11, a kraft pine pulp which had been washed and screened was employed. The pulp slurry had a consistency of 0.28%, a pH of 12.0, and temperature of 20° C. In each run the irradiation time was 60 minutes while employing a Vycor filter.

TABLE XII

EFFECT OF PULP SLURRY pH ON THE PROPERTIES OF PHOTO-OXYGENATED LABORATORY-MADE KRAFT PINE PULP (WASHED AND SCREENED)

| Run No. | pH of Pulp Slurry | Permanganate No. | Diano Brightness % | Viscosity xan. sec. | Viscosity cp. |
|---|---|---|---|---|---|
| Control | — | 24.8 | 19 | 341 | 23.2 |
| 1. | 2.5 | 19.0 | 22 | 131 | 17.0 |
| 2. | 4.5 | 19.9 | 21 | 185 | 19.0 |
| 3. | 6.5 | 21.7 | 20 | 271 | 21.4 |
| 4. | 8.5 | 21.8 | 19 | 247 | 20.8 |
| 5. | 10.5 | 21.1 | 19 | 253 | 21.1 |
| 6. | 12.0 | 15.3 | 24 | 158 | 17.9 |

EXAMPLE 13

In Run Nos. 1–16 and Controls A-D, the type of wood shown in Table 12 was subjected to the kraft process. In Controls A and B and Run Nos. 1–8, the wood chips were subjected to prehydrolysis prior to being cooked. In Controls C and D and Run Nos. 9–16, the chips were not prehydrolyzed prior to the kraft cook. In Run Nos. 1–16 and Controls A–D, the pulp consistency was 0.28%, the slurry pH was 12, the temperature of the slurry was 20° C. and a Vycor filter was used. Oxygen was admitted at the rate of 5 standard liters per minute.

In Run Nos. 17–20, the pulp consistency was 0.28%, the temperature of the pulp slurry was 20° C., the slurry pH was 3.0 and a Vycor filter was used. Nitrogen, at the rate of 5 standard liters per minute (SLPM), was admitted in each of these experiments. In Runs 17 and 18, the chips had been prehydrolyzed, while in Runs 19 and 20 they had not been prehydrolyzed.

In Run Nos. 21–24, the pulp consistency was 0.28%, the slurry temperature was 20° C., the pH of the slurry was 12.0, and a Vycor filter was used. Nitrogen, at the rate of 5 SLPM was admitted in each of these experiments. In Runs 21 and 22, the chips had been prehydrolyzed, while in Runs 23 and 24 they had not been prehydrolyzed.

In Run Nos. 25–28, the pulp consistency was 0.28%, the temperature of the slurry was 20° C., the pH was 3.0, and a Vycor filter was used. Oxygen at the rate of 5 SLPM was admitted in each of these experiments. In Runs 25 and 26, the chips were prehydrolyzed while in Runs 27 and 28 they had not been prehydrolyzed.

In Run Nos. 4, 8, 12 and 16, the pulp slurry was irradiated for 60 minutes, the slurry water was then exchanged with fresh water, and the pulp slurry was then irradiated for an additional 60 minutes.

TABLE XIII

SLURRY PHOTOLYSIS OF VARIOUS LABORATORY-MADE LIGNOCELLULOSIC PULPS

| Run No. | Wood Type | Pulp Type | Irradiation Time, Min. | Permanganate No. | Diano Brightness % | Viscosity xan.sec. | Viscosity cp. |
|---|---|---|---|---|---|---|---|
| Control A | Hardwood | Dissolving | — | 7.1 | 37 | 1952 | 40.3 |
| 1. | Hardwood | Dissolving | 30 | 2.0 | 56 | 84 | 14.8 |
| 2. | Hardwood | Dissolving | 60 | 0.8 | 71 | 32 | 10.9 |
| 3. | Hardwood | Dissolving | 120 | 0.5 | 81 | 8 | 7.1 |
| 4. | Hardwood | Dissolving | 120 | 0.1 | 84 | 4 | 5.7 |
| Control B | Pine | Dissolving | — | 18.8 | 27 | 369 | 24.3 |
| 5. | Pine | Dissolving | 30 | 12.3 | 29 | 108 | 16.1 |
| 6. | Pine | Dissolving | 60 | 8.2 | 36 | 33 | 11.0 |
| 7. | Pine | Dissolving | 120 | 2.7 | 59 | 12 | 8.0 |
| 8. | Pine | Dissolving | 120 | 2.8 | 70 | 9 | 7.4 |
| Control C | Pine | Paper | — | 24.8 | 19 | 341 | 23.3 |
| 9. | Pine | Paper | 30 | 20.4 | 18 | 195 | 19.3 |
| 10. | Pine | Paper | 60 | 15.3 | 24 | 158 | 18.1 |
| 11. | Pine | Paper | 120 | 10.4 | 37 | 36 | 11.4 |
| 12. | Pine | Paper | 120 | 5.9 | 43 | 29 | 10.6 |
| Control D | Hardwood | Paper | — | 14.5 | 27 | 2083 | 40.7 |
| 13. | Hardwood | Paper | 30 | 7.1 | 38 | 250 | 21.0 |
| 14. | Hardwood | Paper | 60 | 5.0 | 45 | 132 | 17.1 |
| 15. | Hardwood | Paper | 120 | 2.1 | 72 | 41 | 11.8 |
| 16. | Hardwood | Paper | 120 | 2.1 | 76 | 43 | 12.0 |
| 17. | Hardwood | Dissolving | 60 | 2.1 | 52 | 72 | 14.1 |
| 18. | Pine | Dissolving | 60 | 15.8 | 29 | 117 | 16.3 |
| 19. | Pine | Paper | 60 | 23.4 | 22 | 70 | 14.0 |
| 20. | Hardwood | Paper | 60 | 9.8 | 33 | 594 | 27.7 |
| 21. | Hardwood | Dissolving | 60 | 1.8 | 51 | 55 | 13.0 |
| 22. | Pine | Dissolving | 60 | 14.4 | 29 | 166 | 18.3 |
| 23. | Pine | Paper | 60 | 22.4 | 20 | 158 | 17.9 |
| 24. | Hardwood | Paper | 60 | 12.1 | 30 | 38 | 11.5 |
| 25. | Hardwood | Dissolving | 60 | 1.1 | 61 | 30 | 10.7 |
| 26. | Pine | Dissolving | 60 | 11.1 | 31 | 27 | 10.3 |
| 27. | Pine | Paper | 60 | 19.0 | 22 | 131 | 17.0 |
| 28. | Hardwood | Paper | 60 | 6.7 | 39 | 149 | 17.8 |

The data in Table XIII indicate the effects of various photo-oxygenation parameters on resultant pulp properties of various types of pulps. In general, hardwood pulps require less energy than pin pulps to achieve equivalent pulp properties.

EXAMPLE 14

The results indicated below in Table XIV under the section headed "Corona Discharge Activation" represents the results from experiments 1(d), 1(l), and 1(h) set forth in Table I of Liebergott, U.S. Pat. No. 3,806,404 and also the original softwood pulp employed by Liebergott.

Run Nos. 2, 4, 7 and 9 under the section headed "Photochemical Activation" employed "active" nitrogen generated by ultraviolet irradiation to compare with the results obtained by Liebergott using active nitrogen generated via Corona discharge.

Run Nos. 3, 5, 8 and 10 employed "active" oxygen generated by ultraviolet irradiation in accordance with the present process.

In Run Nos. 1-10, the pulp consistency was 0.28%, the temperature of the pulp slurry was 20° C., and the pulp was irradiated for 60 minutes using a Vycor filter. The flow rates of oxygen and nitrogen were each 5 SLPM.

TABLE XIV

COMPARISON OF VARIOUS METHODS FOR BLEACHING AND DELIGNIFICATION OF LIGNOCELLULOSIC PULPS WITH ACTIVATED GAS

| Run No. | Kappa Number | CED Viscosity cp. | Elrepho Brightness % | End pH |
|---|---|---|---|---|
| Corona Discharge Activation | | | | |
| 1. Original pulp (softwood) | 24.0 | 19.6 | 27.8 | — |
| 1 (d) "Active" $N_2$ | 8.4 | 18.3 | 50.1 | 2.7 |
| 1 (L) "Active" $O_2$ | 22.6 | 19.0 | 28.6 | 1.2 |
| 1 (h) "Active" $N_2$ | 18.0 | 19.2 | 32.2 | 10.2 |
| Photochemical Activation | | | | |
| Run No. | Permanganate Number | CED Viscosity cp. | Diano Brightness % | End pH |
| 1. Original pulp (softwood) | 24.8 | 23.1 | 19 | — |
| 2. "Active" $N_2$ | 23.4 | 14.0 | 22 | 3.0 |
| 3. "Active" $O_2$ | 19.0 | 17.1 | 22 | 3.0 |
| 4. "Active" $N_2$ | 22.4 | 17.3 | 20 | 12.0 |
| 5. "Active" $O_2$ | 15.3 | 17.3 | 24 | 12.0 |
| 6. Original pulp (hardwood) | 7.1 | 37.0 | 40 | — |
| 7. "Active" $N_2$ | 2.1 | 14.2 | 52 | 3.0 |
| 8. "Active" $O_2$ | 1.1 | 10.7 | 61 | 3.0 |
| 9. "Active" $N_2$ | 1.8 | 13.0 | 51 | 12.0 |
| 10. "Active" $O_2$ | 0.8 | 10.9 | 71 | 12.0 |

It is evident from the section headed "Corona Discharge Activation" in Table XIV that Liebergott's process achieved the most significant delignification of softwood when "active" nitrogen was employed at a pH of 2.7. At that pH level, there was a reduction in the Kappa Number of 15.6 units. When "active" oxygen was employed at a pH of 1.2, the Kappa Number was only reduced 1.4 units.

It is apparent from Run Nos. 2-5 that at both pH 3.0, which is representative of Liebergott's experiments, and pH 12.0, which is representative of the present process, softwood was delignified to a much greater extent using oxygen in the presence of ultraviolet irradiation, in comparison to the use of nitrogen in the presence of ultraviolet irradiation. The superiority is most markedly demonstrated at pH 12, which is the preferred pH for the present process. At that pH, the Permanganate Number was only reduced 2.4 units when using "active" nitrogen, while the Permanganate Number using "active" oxygen of the present process was reduced 9.5 units. Thus, using oxygen in accordance with the present process produced an increase in delignification approximately four times as great as when nitrogen was used. What is most surprising, however, is when Liebergott's results with softwood, employing Corona discharge for generating "active" oxygen are compared with the results of the present process employing ultraviolet light and oxygen for generating "active oxygen" in situ.

At acid pH, 1.2, using Corona discharge Liebergott obtained a marginal decrease in his Kappa No., namely, 1.4 units. At acid pH, 3.0, in the present in situ process, the Permanganate Number was reduced 5.8 units. And when a pH of 12.0 was employed in the present process, which is the preferred pH, the Permanganate Number was reduced by 9.5 units. Certainly, the delignification achieved by the present in situ process is completely unexpected in view of Liebergott's results.

When hardwoods are the wood species employed, the benefits of the present in situ process with oxygen are even more pronounced and unexpected when compared with the "active" nitrogen of Liebergott. At acid pH, 3.0, a reduction of 70% delignification was obtained when using nitrogen activated by ultraviolet light. Using "active" oxygen in accordance with the present process at pH 3, a reduction of 80% delignification was achieved. When using the preferred pH, namely, 12.0, of the present process, "active" nitrogen produced a 75% delignification while "active" oxygen produced a 89% delignification. This compares to Liebergott's results showing 65% delignification using "active" nitrogen and only 7% delignification using "active" oxygen. From all of the foregoing it is evident that oxygen is superior to nitrogen in delignification capability when using either hardwood or softwood.

The terms and expressions which have been employed are used as terms of description and not of limitation, and there is no intention in the use of such terms and expressions of excluding any equivalents of the features shown and described or any portion thereof, but it is recognized that various modifications are possible within the scope of the invention as claimed.

What is claimed is:

1. A process for delignification and bleaching of lignocellulosic pulp employing electronically excited oxygen generated in situ, which comprises:

subjecting an aqueous slurry of said lignocellulosic pulp having a consistency of from about 0.01% to about 10.0%, by weight of oven-dried pulp, and whose slurry pH is between about 8 and about 13 to irradiation with ultraviolet light while admitting oxygen into said slurry, whereby the ultraviolet light excites the oxygen to produce electronically excited oxygen in situ which bleaches and delignifys the pulp.

2. A process in accordance with claim 1 wherein the consistency of the pulp slurry is between about 0.1% and about 2.0%, by weight.

3. A process in accordance with claim 1 wherein the consistency of the pulp slurry is between about 0.2% and about 1.0%.

4. A process in accordance with claim 1 wherein the pH of the pulp slurry is between about 10 and about 12.5.

5. A process in accordance with claim 1 wherein the pulp is a kraft hardwood pulp.

6. A process in accordance with claim 1 wherein the pulp is a kraft softwood pulp.

7. A process in accordance with claim 1 wherein the temperature of the pulp slurry is from about 10° C. to about 50° C.

8. A process in accordance with claim 1 wherein the temperature of the pulp slurry is from about 20° C. to about 30° C.

9. A process in accordance with claim 1 wherein photo-sensitizers are absent from the pulp slurry.

10. A process in accordance with claim 1 wherein the irradiation is conducted between about 3500 angstroms and about 3000 angstroms.

11. A process in accordance with claim 1 and including the prior step of subjecting said lignocellulosic pulp slurry to an oxygen/alkali bleach.

12. A process for the delignification and bleaching of lignocellulosic pulp employing electronically excited oxygen generated in situ, which comprises:

subjecting an aqueous slurry of said lignocellulosic pulp having a consistency of about 0.2 to about 1%, by weight of oven-dried pulp, and whose slurry pH is between about 10 and about 12.5 to irradiation with ultraviolet light in the absence of photo-sensitizers while admitting oxygen into said slurry.

* * * * *